US010858766B2

(12) United States Patent
Usuki

(10) Patent No.: US 10,858,766 B2
(45) Date of Patent: Dec. 8, 2020

(54) INDUSTRIAL FABRIC

(71) Applicant: NIPPON FILCON CO., LTD., Inagi (JP)

(72) Inventor: Tsutomu Usuki, Fuji (JP)

(73) Assignee: NIPPON FILCON CO., LTD., Tokyo (JP)

( * ) Notice: Subject to any disclaimer, the term of this patent is extended or adjusted under 35 U.S.C. 154(b) by 233 days.

(21) Appl. No.: 14/906,722

(22) PCT Filed: Jun. 3, 2014

(86) PCT No.: PCT/JP2014/064698
§ 371 (c)(1),
(2) Date: Jan. 21, 2016

(87) PCT Pub. No.: WO2015/015895
PCT Pub. Date: Feb. 5, 2015

(65) Prior Publication Data

US 2016/0160405 A1 Jun. 9, 2016

(30) Foreign Application Priority Data

Jul. 31, 2013 (JP) ..... 2013-159362

(51) Int. Cl.
*D03D 11/00* (2006.01)
*D03D 1/00* (2006.01)
(Continued)

(52) U.S. Cl.
CPC ..... *D03D 11/00* (2013.01); *D03D 1/0094* (2013.01); *D03D 13/00* (2013.01);
(Continued)

(58) Field of Classification Search
CPC ..... D03B 11/00; D03D 11/00; D03D 1/0094
(Continued)

(56) References Cited

U.S. PATENT DOCUMENTS 3,885,603 A * 5/1975 Slaughter ..... D21F 1/0036 139/383 A
3,957,090 A * 5/1976 Muhlen ..... B31F 1/2845 139/409
(Continued)

FOREIGN PATENT DOCUMENTS

JP 2002-523653 A 7/2002
JP 2003-82594 A 3/2003
(Continued)

OTHER PUBLICATIONS

International Search Report with English translation issued in Application No. PCT/JP2014/064698 dated Sep. 16, 2014 (5 pages).

*Primary Examiner* — Jenna L Johnson
(74) *Attorney, Agent, or Firm* — Michael Best & Friedrich LLP

(57) ABSTRACT

An industrial fabric includes upper surface side warps, lower side warps, wefts and an auxiliary yarn. Each of the lower side warps is arranged below each of the upper side warps respectively. The upper side warps and the lower side warps are woven by the wefts. The auxiliary yarn is disposed between the upper side warps and the lower side warps without being woven by the upper side warps and the lower side warps. The auxiliary yarn is disposed between two of the adjacently disposed wefts.

5 Claims, 1 Drawing Sheet

(51) Int. Cl.
*D03D 15/00* (2006.01)
*D03D 13/00* (2006.01)

(52) U.S. Cl.
CPC ... *D03D 15/0094* (2013.01); *D10B 2321/042* (2013.01); *D10B 2505/00* (2013.01)

(58) Field of Classification Search
USPC ..... 139/383 R, 408–415
See application file for complete search history.

(56) References Cited

U.S. PATENT DOCUMENTS

| | | | | |
|---|---|---|---|---|
| 4,821,780 | A * | 4/1989 | Tate | D21F 1/0036 139/383 A |
| 5,449,026 | A * | 9/1995 | Lee | D21F 1/0036 139/383 A |
| 6,223,781 | B1 | 5/2001 | Yamada et al. | |
| 6,267,150 | B1 | 7/2001 | Herring | |
| 6,273,146 | B1 | 8/2001 | Herring | |
| 6,273,147 | B1 | 8/2001 | Herring | |
| 6,284,678 | B1 * | 9/2001 | Kobayashi | D03D 1/0094 139/394 |
| 6,289,940 | B1 | 9/2001 | Herring | |
| 6,318,413 | B1 | 11/2001 | Herring | |
| 7,059,358 | B2 | 6/2006 | Ogiwara | |
| 8,899,276 | B2 | 12/2014 | Takahashi et al. | |
| 2004/0159362 | A1 | 8/2004 | Ogiwara | |
| 2013/0206276 | A1 * | 8/2013 | Takahashi | D03D 3/00 139/383 AA |
| 2014/0127959 | A1 | 5/2014 | Usuki et al. | |
| 2014/0202649 | A1 | 7/2014 | Oouchi et al. | |

FOREIGN PATENT DOCUMENTS

| | | | |
|---|---|---|---|
| JP | 2003-247191 | A | 9/2003 |
| JP | 3938817 | B2 | 6/2007 |
| JP | 2013-36157 | A | 2/2013 |
| JP | 2014-141769 | A | 8/2014 |
| WO | WO 2012/140993 | A1 | 10/2012 |

* cited by examiner

INDUSTRIAL FABRIC

TECHNICAL FIELD OF THE INVENTION

The present invention relates to an industrial fabric, in particular, an industrial fabric of double warps-single weft type which is capable of improving a surface smoothness, a rigidity, an wear resistance and dehydration characteristics by adopting a structure in which an auxiliary weft other than wefts woven with upper surface side warps and lower surface side warps is arranged, in particular, relates to a fabric for manufacturing unwoven fabric. In addition, the present invention relates to an industrial fabric of double warps-single weft type which is capable of improving an anti-dirt characteristics by adopting yarns formed by fluorine resin on the upper surface, in particular, relates to a fabric for manufacturing unwoven fabric.

BACKGROUND ART

Conventionally, an industrial fabric woven by wefts and warps has been used for a transporting or filtering application in a manufacturing process of papers, unwoven fabric, building material, etc. For instance, many kinds of industrial fabrics, such as the fabric for manufacturing unwoven fabric, the fabric for hydrating sludge, the belt for manufacturing the building material, the conveyor belt, and the filtering cloth are widely known. Such industrial fabric needs to possess a high rigidity, a permeability, a good dimension stability, an wear resistance, and anti-dirt characteristics, etc. for any applications.

More specifically, the high rigidity is required in order to hold and transport an object such as material, flotation material component, etc. In particular, in case of the manufacturing process of the building material, or the filtering process under a severe environment, the high rigidity is essential for the fabric which deals with the heavy material or the flotation material component. Further, the dimension stability is needed in order to constantly run the fabric in a stable manner. In addition, in order to always supply products of papers, unwoven fabric, or the building material with stable quality, the anti-dirt characteristics is important for efficient filtering and transportation.

In particular, the anti-dirt characteristics of the fabric is important for an air raid process which is one of the processes of manufacturing unwoven fabric, since it is closely associated with the problem of adhesion of fibers. Here, the air raid process is the process in which pulp sheet and synthetic fibers of short fibers are dispersed in air to be formed on a wire. If the permeability of the fabric is deteriorated, it becomes technically difficult to effect the air raid process efficiently.

In addition, the fabric with a sufficient surface smoothness as to make a transfer of wire mark of the fabric to the unwoven fabric difficult, and the fabric which is capable of keeping the conditions required for manufacturing a good unwoven fabric, for a long time have been desired in the art. Further, the fiber supportability, the yield of the unwoven fabric, and the running stability have been required. In particular, since the speed at which the manufacturing machine is run has recently become high, the request for the fabric used for the transportation has become severe.

The problems of the surface smoothness arises at a location where the upper surface side warp and the weft are woven with each other. For instance, in a case where the diameter of the fiber of the weft which is woven with the upper surface side warp and the lower surface side warp increases, the concave marl arises on the surface of the paper by the knuckle of the upper surface side warp passing above the weft. On the other hand, in a case where the diameter of the fiber of the weft which is woven with the upper surface side warp and the lower surface side warp decreases, since the rigidity of the weft is deteriorated to largely influence on the rigidity of the fiber, the durability of the product of the fabric is shortened.

In particular, if the weft woven with the upper surface side warp and the lower surface side warp gets worn or cut, the product life of the fabric ends.

Recently, yarns and resin material with a view to attain the anti-dirt effect have been developed, in particular. For instance, in a fabric for unwoven fabric in Patent Publication 1, the upper surface side fabric is constituted by yarns including an anti-dirt function such as fluorine resin, more specifically, the ones by blending fluoro polymer such as copolymer of ethylene-tetrafluoroethylene (referred to as "ETFE" hereinafter) and dicarboxylic acid in aromatic series such as polyethylene terephthalate (referred to as "PET" hereinafter), while the lower surface side fabric is constituted by normal yarns such as PET in order to fulfill the required physical properties such as rigidity. As described above, the material of the yarns for the upper surface side and that for the lower surface side have been adopted in a distinguished manner.

If double wefts vertically overlapped with each other are adopted as binding yarns in such two-layered fabric for unwoven fabric, since the weft forms the knuckle on the upper surface side, the yarns formed by PET with poor anti-dirt effect are exposed on the surface of the fabric, so that the anti-dirt effect caused by the upper surface side fabric of fluorine resin are not sufficiently obtained.

In order to solve such technical problems, if the number of the wefts are decreased, the rigidity of the fabric gets decreased. That is why the technology for improving the surface smoothness by increasing the density of the warps so as to increase the number of the knuckles by the warps on the fabric surface has been required.

Patent Publication 1: WO/2012/140993

Patent Publication 2: Japanese Patent No. 3938817

DISCLOSURE OF THE INVENTION

Technical Problems to be Solved by Present Invention

An object of the present invention is to provide an industrial fabric which is capable of improving a surface smoothness by restricting a formation of a knuckle by wefts on a fabric surface. Another object of the present invention is to provide an industrial fabric of a double warps-single weft type which is capable of improving a rigidity, an wear resistance, and a permeability. An object of the present invention is to provide an industrial fabric which is capable of controlling an on-stack structure of an upper surface side warp and lower surface side warp. An object of the present invention is to provide an industrial fabric which is capable of improving an anti-dirt effect on the upper surface side and lengthening the durability of a product, while at the same time of keeping the strength of weaving the upper surface side and the lower surface side, in a case where yarns exposed to the upper surface side are formed by the ones which include an anti-dirt effect such as fluorine resin.

Means to Solve Technical Problems

In order to solve the above technical problems, the present inventor adopted the following structure.

An industrial fabric in which at least an upper surface side warp and a lower surface side warp of an industrial fabric are laminated to be woven by a plurality of wefts comprises an auxiliary weft are kept arranged between the upper surface side warp and the lower surface side warp without the upper and lower surface warps being woven with each other between the adjacent wefts.

The upper side floating yarns may be arranged above the weft so as to be woven with the upper surface side warp only.

An upper side floating yarns may be arranged below the weft so as to be woven with the lower surface side warp only.

A diameter of the auxiliary yarn may be set to be larger than that of the weft.

The upper surface side warp and the upper surface side floating yarn may be made of fluorine resin, and the weft may be constituted by yarns made of material other than fluorine resin.

Effect of the Invention

According to the industrial fabric such as an industrial fabric of double warps-single weft woven type of the present invention, a surface smoothness can be improved by restricting a formation of a knuckle by wefts on a fabric surface. In addition, a rigidity, an wear resistance, and a permeability can be improved. Further, an on-stack structure of an upper surface side warp and lower surface side warp can be controlled. Still further, an anti-dirt effect on the upper surface side can be improved and the durability of a product can be lengthened, while at the same time, the strength of weaving the upper surface side and the lower surface side is kept, in a case where yarns exposed to the upper surface side are formed by the ones which include an anti-dirt effect such as fluorine resin.

BRIEF EXPLANATION OF DRAWINGS

FIG. 2(*a*) is a cross section view taken along 1U and 1L in FIG. 1.

FIG. 2(*b*) is a cross section view taken along 2U and 2L in FIG. 1.

DETAILED DESCRIPTION OF THE INVENTION

Figure 1:
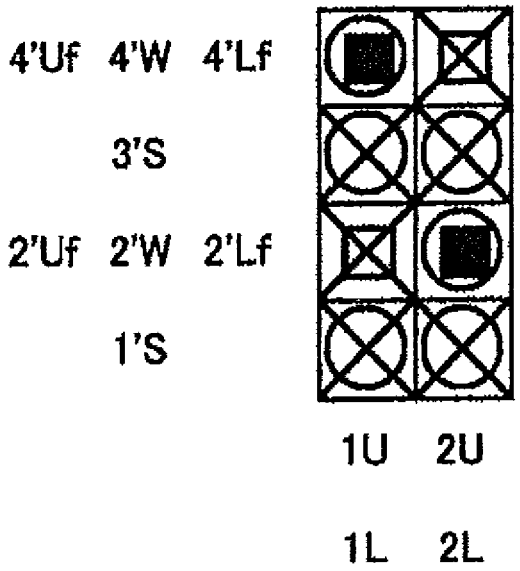
FIG. 1 is a design view showing a complete structure of the first embodiment according to the present invention.

Now, the structure and the effect of the industrial fabric of the present invention will be described below. Embodiments of the industrial fabric of the present invention will be described thereafter with reference to the drawings.

The technical feature of the industrial fabric of the present invention is that the upper surface side warp and the lower surface side warp are laminated to be woven by a plurality of wefts. The density of the warp can be increase by adopting double warps-single weft woven type as a fundamental structure of the industrial fabric. Based on this, the surface smoothness can be highly improved by the fact that the knuckles emerging on the surface of the fabric are formed by the upper surface side warp and the number of the knuckles is increased.

In addition, according to the industrial fabric of double warps-single weft woven type of the present invention, the auxiliary weft is arranged between the adjacent wefts. The technical feature of the auxiliary weft is that the auxiliary wefts are kept arranged between the upper surface side warp and the lower surface side warp without the upper and lower surface warps being woven with each other between the adjacent wefts. Although the surface smoothness can be highly improved by adopting double warps-single weft woven type as a fundamental structure of the industrial fabric, the rigidity is decreased. In order to solve such a technical problem, the specific auxiliary wefts are kept arranged between the upper surface side warp and the lower surface side warp without the upper and lower surface warps being woven with each other between the adjacent wefts. The rigidity same as that of the conventional fabric of double-wefts type can be obtained by such specific auxiliary wefts.

Further, in the industrial fabric of double warps-single weft woven type of the present invention, upper side floating yarns may be arranged above the weft so as to be woven with the upper surface side warp only. In the industrial fabric of the present invention, material with an excellent rigidity such as PET is adopted as the wefts in order to improve the rigidity. While on the other hand, a technical problem in which the wefts emerge on the surface of the fabric is raised. By arranging the upper side floating yarns above the weft, such a technical problem is solved, in other words, the wefts are prevented from emerging on the surface of the fabric.

Still further, in the industrial fabric of double warps-single weft woven type of the present invention, lower side floating yarns may be arranged below the weft so as to be woven with the lower surface side warp only. By contacting such floating yarns with the upper surface side warps and/or the lower surface side warps, the shift of the warps can be controlled so as to adjust the positions at which the upper and lower warps are overlapped with each other, whereby the on-stack structure of the upper and lower warps can be controlled.

Still further, in the industrial fabric of double warps-single weft woven type of the present invention, the diameter of the auxiliary weft may be set to be larger than that of the weft. By making the diameter of the auxiliary weft large, the degree of the exposure of the warp on the surface can be largely increased. In addition, the rigidity of the fabric can be largely increased by adopting the auxiliary weft with the large diameter. Further, the wefts are bound inside, even if the upper surface side floating yarns are not used, by adopting the auxiliary weft with the large diameter. Still further, the shift of the upper and lower warps can be controlled, whereby the on-stack structure of the upper and lower warps can be controlled by adopting the auxiliary weft with the large diameter.

The upper surface side warps and the upper surface side floating yarns may be preferably formed by fluorine resin, and the weft may be preferably formed by yarns made of material other than fluorine resin.

By adopting such a structure, since yarns emerging on the surface can be formed by fluorine resin with excellent anti-dirt characteristic, anti-dirt effect can be sufficiently obtained. In addition, since the number of relatively expensive yarns made of fluorine resin in the lateral direction can be decreased, the cost of manufacturing the fabric can be lowered.

Further, by adopting such a structure, the wefts with the binding function can be formed by yarns with higher strength than that of fluorine resin, such as PET. The inner binding in which the binding yarns are not exposed on the surface by adopting the wefts as the binding yarns. In other words, the yarns such as PET can be prevented from being exposed on the surface of the upper surface side fabric formed by only fluorine resin.

The fluorine resin which is material for the upper surface side warps and the upper surface side wefts of the fabric of the present invention may be preferably composite resin containing fluorine with high anti-dirt. For instance, at least one material can be selected from a group of polytetrafluoroethylene (PTFE), copolymer of tetrafluoroethylene and hexafluoropropylene (FEP), copolymer of tetrafluoroethylene and fluoro vinyl ether (PFA), polyvinylidene fluoride (PVDF), copolymer of ethylene and tetrafluoroethylene (ETFE), and copolymer of ethylene and chlorotrifluoroethylene (ECTFE). In particular, ETFE is suitable for the anti-dirt characteristics and cost.

In this connection, it is preferable to impregnate silicon resin in the fluorine resin material (water dispersion) in order to improve the flexibility. In addition, the color of the surface of the fabric can be freely changed by adding various kinds of pigment to the fluorine resin material (water dispersion).

The material of the yarns other than fluorine resin used for the wefts of the industrial fabric of the present invention can be freely selected in accordance with the characteristics desired for the industrial fabric, and is not limited to the specific material.

The configuration of the yarn includes, in addition to monofilaments, multifilaments, spun yarns, finished yarns subjected to crimping or bulking such as so-called textured yarn, bulky yarn and stretch yarn, taslan yarns, mole yarns, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, cotton, wool and metal. Of course, yarns obtained using copolymers or incorporating or mixing the above-described material with a substance selected depending on the intended purpose may be used.

In particular, in a case where spun yarns, processed yarns such as crimping or bulking, or the flexible yarns with a large diameter such as mole yarn, for the upper layer weft is used, the upper layer surface tends to be covered by theses yarns, so that the difference of the appearance between the bonding portion and the ordinary portion can be hardly distinguished from each other, from the upper layer side.

The material of the yarns other than fluorine resin used for the wefts of the industrial fabric of the present invention can be freely selected in accordance with the characteristics desired for the industrial fabric, and is not limited to the specific material.

The configuration of the yarn includes, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

Since the yarn constituting the fabric for unwoven fabric generally includes a high rigidity, polyester monofilaments with excellent dimension stability may be preferably adopted.

Further, in the industrial fabric of the present invention, the ratio of the arrangement of the upper surface side floating yarn and/or the lower surface side floating yarn to the weft may preferably be set to be 1:1. The shift of the warp can be restricted by adopting such a structure to cause the warp to contact the floating yarn. In particular, the looseness of the warp can be fully controlled by sandwiching a single weft between a single upper surface side floating yarn and a single lower surface side floating yarn.

Now, the embodiments of the present invention will be described below with reference to the drawings. FIG. 1 is the conceptual plain view showing the complete structure of the first embodiment 1. The industrial fabric of the first embodiment is the one for unwoven fabric. Here, the design view corresponds to the complete structure of the fabric defining the minimum unit to be repeated of the fabric structure. The fabric recited in the claims corresponds to this complete structure. The final product is completed by combining any number of such complete structures in the longitudinal direction and the direction perpendicular to the longitudinal direction.

In each of the design views, the warp is indicated by a reference number such as 1,2, while the weft is indicated by a reference number such as 1', . . . 4'. The upper and lower warps are indicated by the reference number to which U and L are attached, respectively. The weft which functions as the binding yarn is indicated by adding W, such as 2'W. Further, the auxiliary weft is indicated by S, while, the floating yarn is indicated by f.

In each of the design views, a symbol "X" indicates that the upper surface side warp is arranged above the upper surface side weft to form a knuckle on the surface of the fabric, and a symbol "○" indicates that the lower surface side warp is arranged below the weft. A solid square symbol "■" indicates that the upper surface side floating yarn is arranged above the upper surface side warps to form a knuckle on the surface of the fabric, and an open square symbol "□" indicates that the lower surface side floating yarn is arranged below the lower surface side warps.

The upper surface side warps and the lower surface side warps are overlapped in the vertical direction to form an on-stack structure.

As shown in FIG. 1, in the industrial fabric for the unwoven fabric of the present invention, the upper surface side warps (1U,2U) and the lower surface side warps (1L, 2L) are laminated in the vertical direction. Such upper and lower surface side warps are woven with a plurality of wefts (2'W, 4'W).

Auxiliary wefts (1'S,3'S) are arranged between the adjacent wefts (2'W, 4'W) and kept located between the upper surface side warps (1U,2U) and the lower surface side warp (1L,2L) without being woven with the upper and lower surface side warps.

Figure 2:
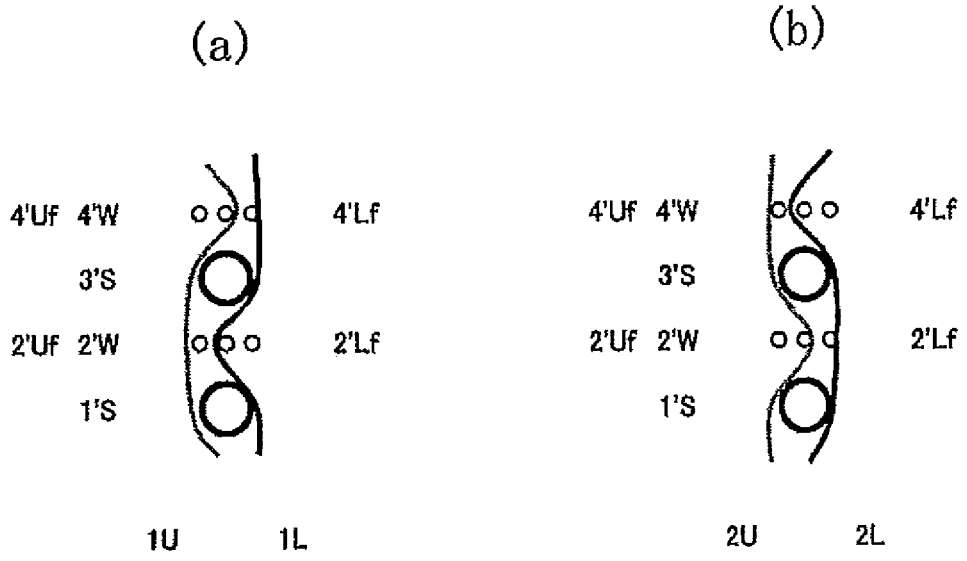
FIG. 2 is a cross section view taken along the warp of the first embodiment.

As shown in FIG. 2(*a*), in the industrial fabric for the unwoven fabric of the present invention, upper surface side floating yarns (2'Uf, 4'Uf) are arranged above the wefts (2'W 4'W) with being woven with the upper surface side warp (1U) only. In addition, the upper surface side warp (1U) passes over the upper surface side floating yarn (2'Uf) and passes under the upper surface side floating yarn (4'Uf). Further, the upper surface side warp (1U) passes under the weft (4'W). The lower surface side warp (1L) passes above the weft (2'W). Still further, lower surface side floating yarns (2'Lf, 4'Lf) are arranged below the wefts (2'W, 4'W) with being woven with the lower surface side warp (1L) only.

Such being the case, the rigidity same as that of the conventional double-wefts type can be obtained by arranging the auxiliary wefts (1'S,3'S) between the adjacent wefts (2'W, 4'W).

Here, the ratio of arrangement of the upper surface side floating yarn and the lower surface side floating yarn to the weft is set to be 1:1. The technical problem in which the wefts (2'W, 4'W) emerge on the surface of the fabric can be solved by arranging the upper surface side floating yarns (2'Uf, 4'Uf) above the wefts (2'W, 4'W).

In the fabric for unwoven fabric of the first embodiment, the density of the knuckles can be increased to improve the surface smoothness by forming the knuckles emerging on the surface by means of the upper surface side warps (1U,2U) only.

EXPLANATION OF SYMBOLS

1U, 2U: upper surface side warp
1L, 2L: lower surface side warp
2'W, 4'W: weft
1'S, 3'S: auxiliary weft
2'Uf, 4'Uf: upper surface side floating yarn
2'Lf, 4'Lf: lower surface side floating yarn

What is claimed is:

1. An industrial fabric, comprising upper surface side warps, lower side warps, wefts and an auxiliary yarn, the upper surface side warps, the lower side warps and the wefts form the industrial fabric;

wherein each of the lower side warps is arranged below each of the upper side warps respectively;

the upper side warps and the lower side warps are woven by the wefts;

the auxiliary yarn is disposed between the upper side warps and the lower side warps, none of the upper side warps goes under the auxiliary yarn and none of the lower side warps goes over the auxiliary yarn; and the auxiliary yarn is disposed between two of the adjacently disposed wefts, wherein the wefts include upper wefts, middle wefts and lower wefts, each of the upper wefts is stacked above each of the middle wefts and each of the middle wefts is stacked above each of the lower wefts;

each of the upper warps goes over the upper wefts or under the middle wefts and does not go under the lower wefts; and each of the lower warps goes over the middle wefts or under the lower wefts and does not goes over the upper wefts.

2. The industrial fabric according to claim 1, wherein the auxiliary yarns are disposed between the upper wefts, between the middle wefts or between the lower wefts.

3. An industrial fabric comprising a minimum repeated unit, wherein the repeated unit consisting of a first upper warp, a second upper warp that is disposed adjacent to the first upper warp, the first upper warp is stacked above a first lower warp, the second upper warp is stacked above a second lower warp, a first upper weft that is stacked above a first middle weft, the first middle weft is stacked above a first lower weft, a second upper weft that is stacked above a second middle weft, the second middle weft is stacked above a second lower weft, a first auxiliary yarn arranged adjacent to one side of the first upper weft, the first middle weft or the first lower weft and a second auxiliary yarn that is arranged between the first and second upper wefts, between the first and second middle wefts or between the first and second lower wefts, the second auxiliary yarn is arranged adjacent to another side that is opposite to the one side of the first upper weft, the first middle weft or the first lower weft;

wherein in the repeated unit, the first upper warp goes over the first auxiliary yarn, over the first upper weft, over the second auxiliary yarn and between the second middle and second lower wefts, the first lower warp goes under the first auxiliary yarn, between the first upper and first middle wefts, under the second auxiliary yarn and under the second lower weft, the second upper warp goes over the first auxiliary yarn, between the first middle and first lower wefts, over the second auxiliary yarn and over the second upper weft, the second lower warp goes under the first auxiliary yarn, under the first lower weft, under the second auxiliary yarn and between the second upper and second middle wefts.

4. The industrial fabric according to claim 3, wherein a diameter of the auxiliary yarn is larger than a diameter of the wefts.

5. The industrial fabric according to claim 3, wherein the upper surface side warps are made of fluorine resin, and the wefts are made of material other than fluorine resin.

* * * * *